US011193344B2

(12) United States Patent
Chapman et al.

(10) Patent No.: US 11,193,344 B2
(45) Date of Patent: Dec. 7, 2021

(54) FRACTURING TOOL

(71) Applicant: SPEX Corporate Holdings Ltd., Aberdeen (GB)

(72) Inventors: Barry Chapman, Aberdeen (GB); David James Wilkie, Aberdeen (GB)

(73) Assignee: SPEX CORPORATE HOLDINGS LTD., Aberdeen (GB)

( * ) Notice: Subject to any disclaimer, the term of this patent is extended or adjusted under 35 U.S.C. 154(b) by 138 days.

(21) Appl. No.: 16/471,817

(22) PCT Filed: Dec. 21, 2017

(86) PCT No.: PCT/GB2017/053869
§ 371 (c)(1),
(2) Date: Jun. 20, 2019

(87) PCT Pub. No.: WO2018/115892
PCT Pub. Date: Jun. 28, 2018

(65) Prior Publication Data

US 2020/0115981 A1 Apr. 16, 2020

(30) Foreign Application Priority Data

Dec. 23, 2016 (GB) ..... 1622103

(51) Int. Cl.
*E21B 29/02* (2006.01)
*E21B 43/119* (2006.01)

(52) U.S. Cl.
CPC ..... *E21B 29/02* (2013.01); *E21B 43/119* (2013.01)

(58) Field of Classification Search
CPC ..... E21B 29/02; E21B 43/119; E21B 43/263; E21B 43/117; E21B 43/116
See application file for complete search history.

(56) References Cited

U.S. PATENT DOCUMENTS 1,758,358 A * 5/1930 Ennis ..... F42B 3/02 102/317
1,816,100 A * 7/1931 Ulrik ..... F42B 3/02 102/317

(Continued)

FOREIGN PATENT DOCUMENTS

RU 2093660 C1 10/1997
WO 2013032991 A2 3/2013
WO 2015152934 A1 10/2015

OTHER PUBLICATIONS

International Search Report for corresponding PCT Application No. PCT/GB2017/053869, dated Mar. 21, 2018.

(Continued)

*Primary Examiner* — Blake E Michener
(74) *Attorney, Agent, or Firm* — Tarolli, Sundheim, Covell & Tummino LLP

(57) ABSTRACT

A tool for fracturing at least one tubular is described. The tool comprises a plurality of parallel columns of explosives and a detonation system configured to detonate the columns of explosives. The columns are arranged such that upon detonation, at least a portion of the Shockwave propagating in a direction outwardly from the tool from one column combines with at least a portion of the Shockwave propagating in a direction outwardly from the tool from another column to create a combined Shockwave of greater intensity than either of the Shockwaves which formed the combined Shockwave.

15 Claims, 7 Drawing Sheets

(56) References Cited

U.S. PATENT DOCUMENTS 2,587,244 A * 2/1952 Sweetman ..... E21B 29/06 175/4.6
2,779,278 A * 1/1957 Klotz, Jr. ..... F42B 3/08 102/310
2,831,429 A * 4/1958 Moore ..... F42B 3/08 102/307
2,839,997 A * 6/1958 Church ..... F42B 12/14 102/307
2,935,020 A * 5/1960 Howard ..... E21B 29/02 102/307
2,984,307 A * 5/1961 Barnes ..... F42B 3/08 175/4
3,241,488 A * 3/1966 Glass ..... E21B 43/117 102/310
3,422,760 A * 1/1969 Mohaupt ..... E21B 43/263 102/313
3,734,018 A 5/1973 Gillingham
4,018,293 A * 4/1977 Keller ..... E21B 43/263 175/4.5
4,160,412 A 7/1979 Snyer
4,184,430 A * 1/1980 Mock ..... B26F 3/04 102/307
4,289,072 A 9/1981 Edgell
4,290,486 A * 9/1981 Regalbuto ..... E21B 43/117 166/297
4,329,925 A 5/1982 Hane
4,378,844 A 4/1983 Parrish
4,777,878 A 10/1988 Johnson
5,564,499 A 10/1996 Willis
6,082,450 A * 7/2000 Snider ..... E21B 37/08 166/55.2
6,817,298 B1 * 11/2004 Zharkov ..... E21B 43/006 102/288
6,971,449 B1 * 12/2005 Robertson ..... E21B 29/02 166/297
7,104,326 B2 * 9/2006 Grattan ..... E21B 29/02 166/297
7,819,180 B2 * 10/2010 Zhou ..... E21B 43/263 166/63
7,861,785 B2 * 1/2011 Frazier ..... E21B 43/267 166/299
8,033,333 B2 * 10/2011 Frazier ..... F42B 3/02 166/299
8,127,832 B1 * 3/2012 Bond ..... E21B 43/25 166/63
8,939,210 B2 * 1/2015 Bell ..... E21B 29/02 166/297
9,109,438 B2 * 8/2015 Stehle ..... E21B 43/263
10,000,994 B1 * 6/2018 Sites ..... F42B 1/028
10,094,190 B2 * 10/2018 Grattan ..... E21B 29/02
10,138,720 B2 * 11/2018 Kemick ..... E21B 43/248
10,145,195 B2 * 12/2018 Craddock, Jr. ..... E21B 29/02
10,184,326 B2 * 1/2019 Flores ..... E21B 43/119
2005/0126783 A1 * 6/2005 Grattan ..... E21B 29/02 166/297
2008/0073081 A1 * 3/2008 Frazier ..... F42D 1/043 166/280.1
2014/0083718 A1 * 3/2014 Bell ..... E21B 43/1185 166/378
2017/0081948 A1 3/2017 Balun
2017/0145767 A1 * 5/2017 Craddock, Jr. ..... F42B 3/22
2018/0274342 A1 * 9/2018 Sites ..... E21B 43/117
2018/0291697 A1 * 10/2018 Oag ..... E21B 29/02

OTHER PUBLICATIONS

GB Search Report dated May 11, 2018 for corresponding GB Application No. 1721638.3.

* cited by examiner

SECTION A-A

FRACTURING TOOL

RELATED APPLICATIONS

The present invention is a U.S. National Stage under 35 USC 371 patent application, claiming priority to Serial No. PCT/GB2017/053869, filed on 21 Dec. 2017; which claims priority from Ser. No. 16/221,038, filed 23 Dec. 2016, both of which are incorporated herein by reference.

FIELD

The present invention relates to a tool and a method for fracturing at least one tubular. The tubular or tubulars may be, but are not limited to, downhole tubulars in a hydrocarbon well.

BACKGROUND

During subterranean operations, for example hydrocarbon extraction, it is often desirable to obtain access to the annulus which might exist between, for example, a casing which is lining a subterranean bore and a production tubing located concentrically within the casing. It may be desirable to access this annulus by milling or cutting the production tubing but not damaging the casing, to flow fluids such as an acid wash into the annulus.

In alternative situations, it may be desirable to remove the tubulars, for example casing and associated cement, and then set, for example, a cement plug across the wellbore.

Conventional methods of removing tubulars downhole include using mechanical solutions, such as milling tools or mechanical cutters, to cut through tubulars and casings and associated cement and, where required, right back to the bedrock through which the wellbore was drilled. Milling and mechanical cutters, however, have proven to be a relatively slow and consequently an expensive solution for performing this operation.

SUMMARY

According to a first aspect of the present invention, there is provided a tool for fracturing at least one tubular; the tool comprising:

- a plurality of parallel columns of explosives,
- a detonation system configured to detonate the columns of explosives,
- wherein the columns are arranged such that upon detonation, at least a portion of the shock wave propagating in a direction outwardly from the tool from one column combines with at least a portion of the shock wave propagating in a direction outwardly from the tool from another column to create a combined shock wave of greater intensity than either of the shock waves which formed the combined shock wave.

In at least one embodiment of the present invention, providing a tool with parallel columns of explosives permits, upon detonation, a combined shock wave to be generated of greater intensity than could be generated by either column of explosives independently.

Multiple portions of the shock wave from one column may combine with multiple portions of the shock wave from another column to create multiple combined shock waves. For example, where there are two columns of explosives, two combined shock waves may be formed, the shock waves propagating away from opposite sides of the tool. Where there are three columns of explosives, three combined shock waves may be formed, the shock waves propagating away from the tool at a separation angle of 120°.

The columns of explosives may be configured such that combining shock waves meet at an acute angle to a plane of intersection between shock waves. Such an arrangement prevents the head on collision between shock waves which can dissipate energy. If the shock waves come together at an acute angle to the plane of intersection, then the combined effect of the shock wave is maximized.

In some embodiments, when the tool is disposed longitudinally within a tubular, each combined shock wave may create longitudinal fractures in a section of tubular wall. As the explosives are arranged in columns, the resulting combined shock wave of two adjacent columns will extend the length of the columns. In one embodiment this combined shock wave may impact the tubular surface like a blade.

The fracture may be a full fracture which penetrates through the section of tubular wall.

Alternatively or additionally, the fracture may be a partial fracture which cuts into, but not through, the section of tubular wall.

Between combined shock waves, there may be a region of non-combined shock wave. A region of non-combined shock wave is the shock wave from a single column of explosives which hasn't overlapped with the shock wave of another column of explosives.

In some embodiments, when the tool is disposed longitudinally within a tubular, each non-combined shock wave may create longitudinal bulging in a section of tubular wall.

Each column of explosive may have a circular cross-section. Upon detonation, a column of explosives with a circular cross-section emits a shock wave which propagates radially outwards from the column along the entire length of the column.

Alternatively each column of explosives may have a non-circular cross-section.

In further additional or alternative embodiments, the tool may comprise columns of explosives of different cross sections.

Each column of explosives may comprise a plurality of explosive charges.

Each column may be a stack of explosive charges.

Where the column of explosives has a circular cross-section, each explosives charge may be a disc.

The columns of explosives may be arranged to define an interior void.

Upon detonation, at least a portion of the shock wave from each column of explosives may propagate into the interior void. Whilst not wishing to be bound by theory, it is believed that the shock waves which propagate into the interior void collide and then deflect radially outwards towards the tubular to be fractured. This deflected shock wave enhances the effect of the combined non-combined shock waves on the tubular to be fractured.

In additional or alternative embodiments, each column may include a reflecting section. The reflecting section may be provided to reflect a portion of shock wave which was travelling radially inwards towards a tool longitudinal axis to travelling radially outwards away from the tool longitudinal axis.

Each column may further comprise a column housing.

The column housing may comprise the reflecting section.

In alternative embodiments, the explosives may comprise a sheath configured to act as the reflecting section.

The reflecting section may be utilized to prevent head-on collisions between shock waves. The reflecting section may reflect a first incoming shock wave towards a second incoming shock wave such that they meet at an acute angle to the plane of intersection between shock waves.

The column housing may comprise a focusing mechanism. A focusing mechanism may focus the combined shock wave on a particular section of a tubular wall.

The focusing mechanism may be a slot in the column housing.

The slots may be sealed to prevent ingress of fluids into the tool prior to detonation of the explosives.

The slot may be sealed by means of a seal, the seal configured to, for example, burst at a threshold pressure above environmental pressure within the well.

Alternatively or additionally, the focusing mechanism may be a section of weakness in the column housing.

The tool may further comprise a purging system, the purging system adapted to purge or evacuate fluid in an annulus between the tool and the tubular to be fractured prior to detonation of the explosives. Such an arrangement can enhance the effect of the tool by minimizing the energy lost in propagation of the shock waves and detonation products (largely gases) through, for example, well fluids.

The detonation system may be electrical.

In alternative embodiments the detonation system may be percussive.

The detonation system may be configured to detonate each column of explosives simultaneously.

The columns of explosives may be detonated in a common plane transverse to the longitudinal length of each column. Detonating in a common plane ensures the shock wave effect is maximized within a given plane as explosives charges located on the plane will be detonated at the same time. In a preferred embodiment, the columns of explosives are detonated at an upper end. The upper end, in use, is the end closest to the surface of the wellbore. This ensures that the detonation effect travels away from the surface.

The explosive charges may comprise one or more of the explosives PETN, RDX, HMX, PYX or HNS.

According to a second aspect of the present invention there is provided a method of fracturing at least one tubular, the method comprising:

providing a tool comprising a plurality of parallel columns of explosives;

positioning the tool within a tubular to be fractured such that a tool longitudinal axis is parallel to a tubular longitudinal axis, detonating the plurality of parallel columns of explosives simultaneously, at least one portion of the shock wave from one column combining with at least one portion of the shock wave of another column to create a combined shock wave, the combined shock wave performing at least one longitudinal fracture in the tubular.

According to a third aspect of the present invention, there is provided a tool for fracturing at least one tubular; the tool comprising:

a column of explosives, a detonation system configured to detonate the column of explosives, wherein the column is arranged such that upon detonation, at least a portion of the shock wave propagating in a direction outwardly from the tool from one section of the column combines with at least a portion of the shock wave propagating in a direction outwardly from the tool from another section of the column to create a combined shock wave of greater intensity than either of the shock waves which formed the combined shock wave.

In at least one embodiment, the column defines an interior void.

It will be understood that features listed as preferable in respect of one aspect may be equally applicable to subsequent aspects and have not been repeated for brevity.

BRIEF DESCRIPTION OF THE DRAWINGS

Embodiments of the invention will now be described with reference to the accompanying drawings in which.

DETAILED DESCRIPTION OF THE DRAWINGS

Figure 1:
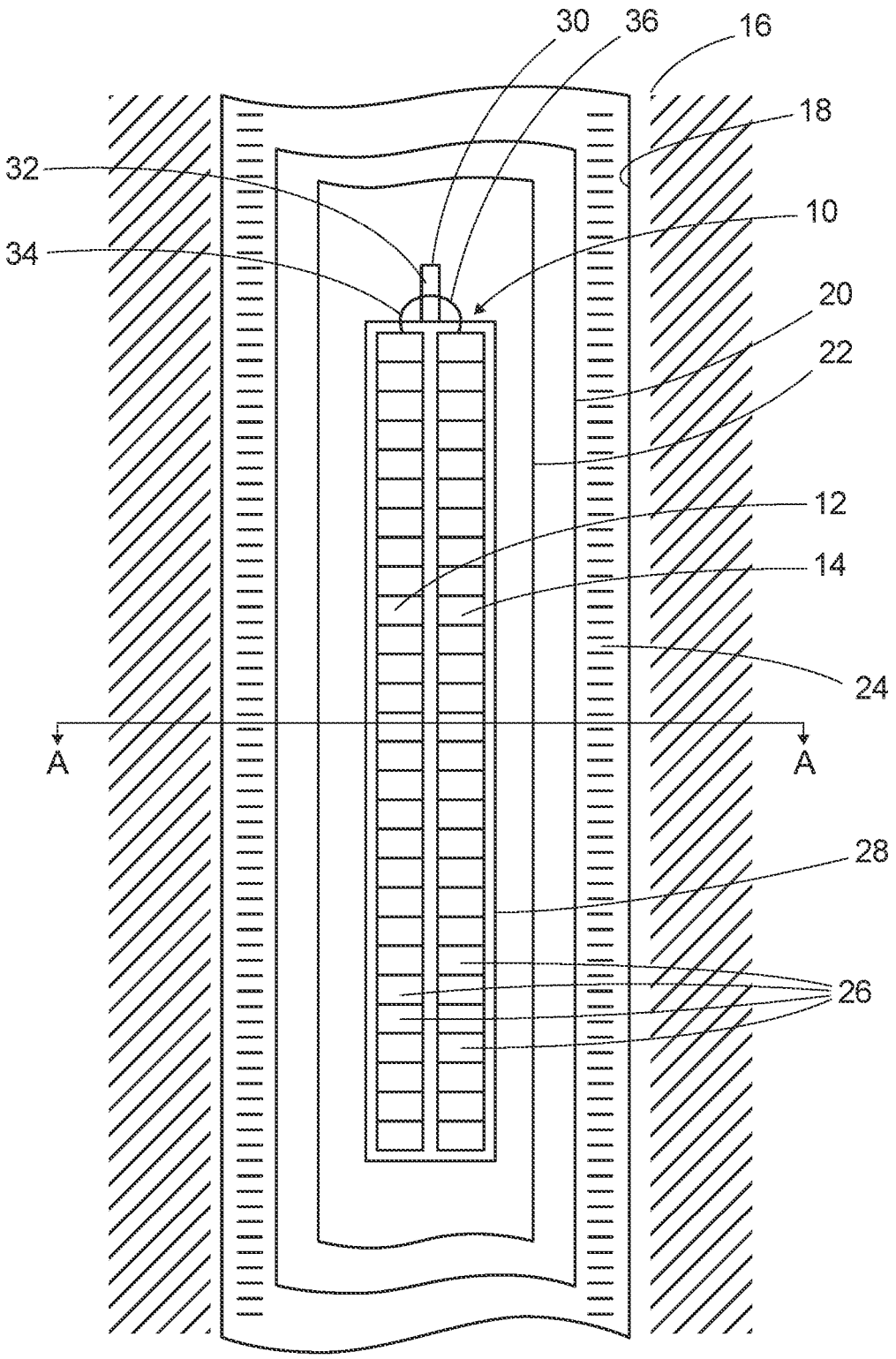
FIG. 1 is a section view of a tool with two columns of explosives according to a first embodiment of the present invention.

Reference is first made to FIG. 1, a section view of a tool, generally indicated by reference numeral 10, with two columns of explosives 12, 14 according to a first embodiment of the present invention.

The tool 10 is shown located within a subterranean wellbore 16 which is lined with a casing 18 and includes a first internal tubular 20 and a second internal tubular 22. The first internal tubular 20 is cemented to the casing 18 by a layer of cement 24. The purpose of the tool 10 is to fracture the first and second internal tubulars 20, 22 and shatter the cement layer 24 but leave the casing 18 undamaged.

Looking more closely at tool 10, the tool 10 comprises the first and second columns of explosives 12, 14, each column of explosives 12, 14 being made up of a plurality of explosive charges 26.

The columns of explosives 12, 14 are disposed within a housing 28 which can be attached to a wireline (not shown) for lowering and raising the tool 10 within the subterranean wellbore 16. An attachment mechanism 30 is provided for attaching to a wireline and other suitable deployment methods. The attachment mechanism 30 also incorporates a detonation system 32 which is connected to the first column of explosives 12 by a first detonation cord 34 and to the second column of explosives 14 by a second detonation cord 36.

When the tool 10 is in the correct location within the subterranean wellbore 16, an electrical signal is sent down the wireline to the detonation system 32 to detonate the columns of explosives 12, 14. The signal is transmitted to the columns of explosives 12, 14 by the detonation cord, triggering an explosion in each column 12, 14 which propagates down the columns 12, 14.

Figure 2:
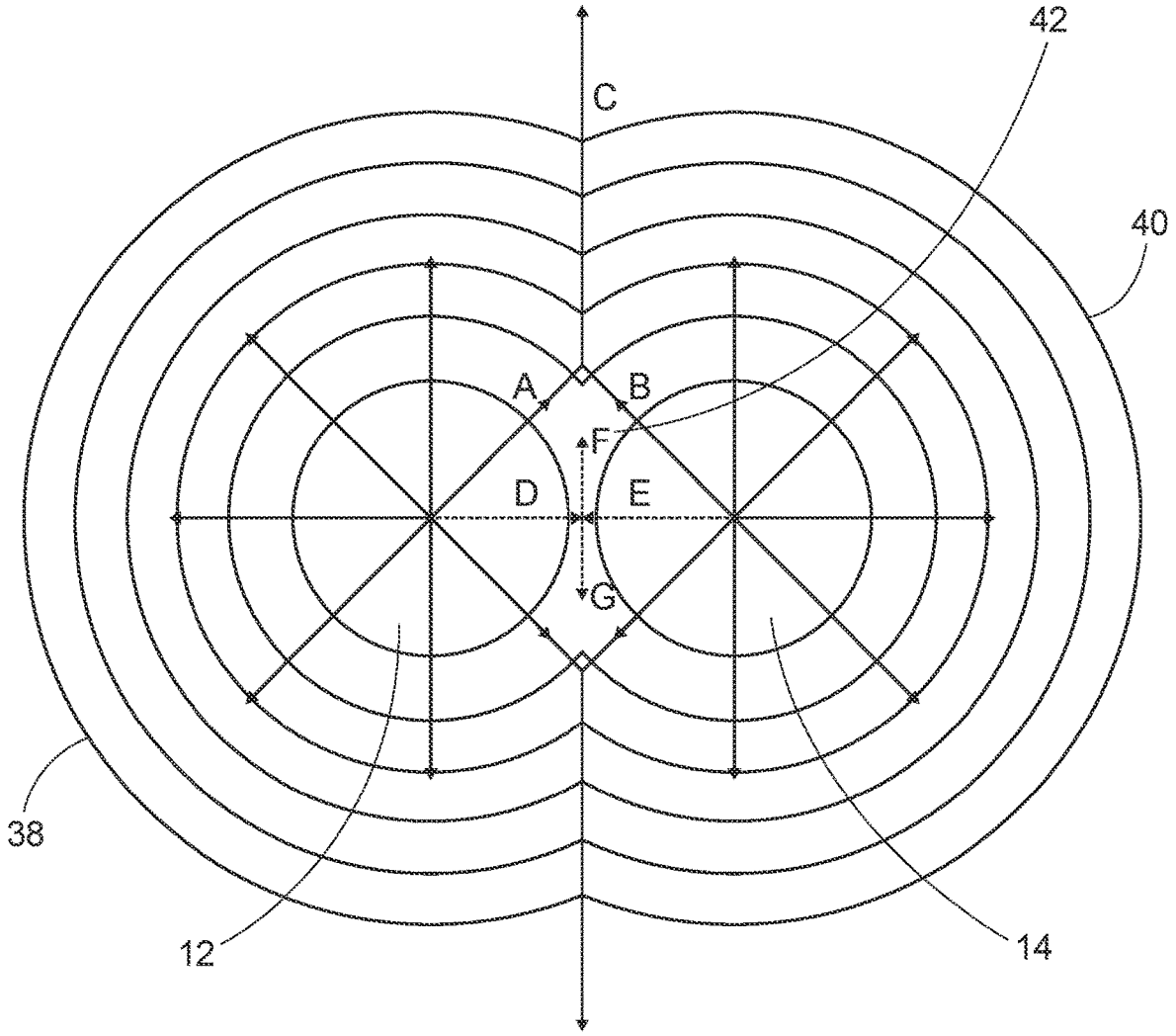
FIG. 2 is a schematic section view through the columns of explosives of the tool of FIG. 1, showing the combining of the shock waves after detonation.

Reference is now made to FIG. 2 a schematic section view through the columns of explosives 12, 14 of the tool 10 of FIG. 1, showing the combining of the shock waves after detonation. Upon detonation of the columns of explosives 12, 14, each column produces a shock wave 38, 40 which propagates radially outwardly from each column 12, 14.

Where the columns 12, 14 face each other, the first column shock wave 38 will combine with the second column shock wave 40 to form a combined shock wave. This is indicated on FIG. 2 by the first column shock wave arrow "A" combining with the second column shock wave arrow "B" to form a combined shock wave arrow "C".

Whilst not wishing to be bound by theory, it is believed that rather than passing through each other, the first and second column shock waves 38, 40 do not pass through each other, but actually combine to form an intense, focused shock wave which due to the arrangement of the tool 10 travels radially outwards from the tool 10, like a longitudinal blade, and impacts substantially perpendicular to the surface of the second tubular 22.

Furthermore, the first and second columns of explosives 12, 14 define a void or region 42 into which the first and second column shock waves 38, 40 will also travel. Representing the first and second column shock waves 38, 40 by arrows "D" and "E" respectively, the shock waves collide in a vertical plane running the length of the columns of explosives 12, 14 and, again not wishing to be bound by theory, it is believed the shock waves 38, 40 propagate radially outwards from the centre of the tool 10 in the direction of arrows "F" and "G".

Figure 3:
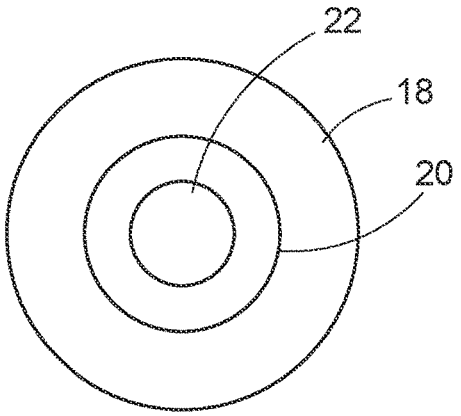
FIG. 3 is a section through line A-A on FIG. 1 prior to detonation.
Figure 4:
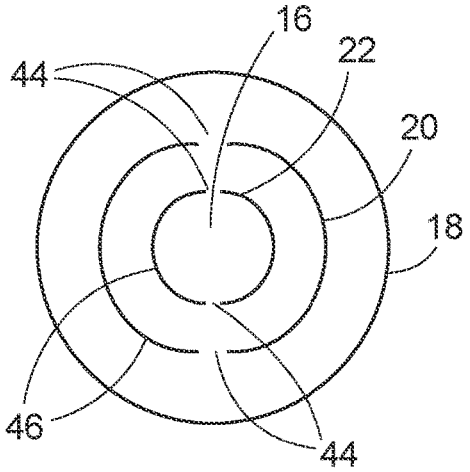
FIG. 4 is a section through line A-A on FIG. 1 after detonation.

Referring now to FIGS. 3 and 4, a section through line A-A on FIG. 1 prior to detonation (FIG. 3) and after detonation (FIG. 4), it can be seen, particularly referring to FIG. 4, that the combined shock waves 38, 40 have created fractures 44 in the first and second tubulars 20, 22.

In addition, it also be noted that the non-fractured sections 46 of the first and second tubulars 20, 22 have expanded or "bellied" radially outwards from the centre of the wellbore 16. This has been caused by the gases created during the detonation of the columns of explosives 12, 14, impacting, in the form of blast waves, on the tubulars 12, 14 causing them to expand and rip open the fracture.

Figure 5:
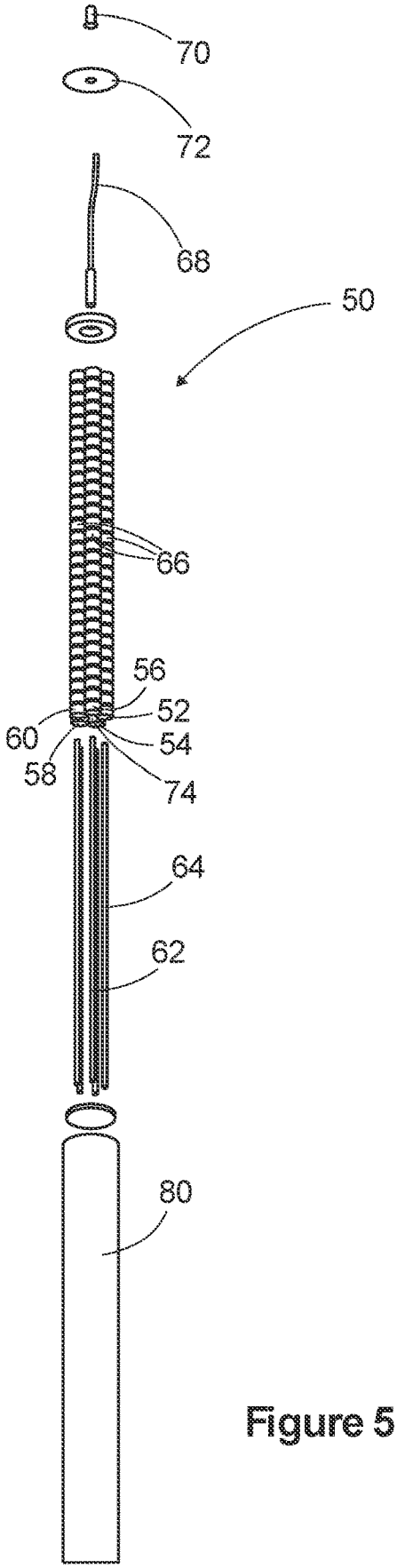
FIG. 5 is an exploded view of a tool with five columns of explosives according to a second embodiment of the present invention.

Reference is now made to FIG. 5, an exploded view of a tool 50 with five columns of explosives 52-60 according to a second embodiment of the present invention. This tool 50 is largely the same as the tool 10 of the first embodiment and only notable differences are made.

It will be noted that within the housing 80, a stacking system 62 of five poles 64 is provided. In this embodiment, the explosives charges 66 which make up each column of explosives 52-60 are toroidal, the central aperture defined by each explosive charge 66 being adapted to receive one of the poles 64, thereby allowing the charges 66 to be stacked in columns.

Also worthy of note on FIG. 5 is the detonator 68 which is suspended from an attachment mechanism 70 through a housing upper plate 72 and communicates with a void 74 defined by the columns of explosives 52-60.

Figure 7:
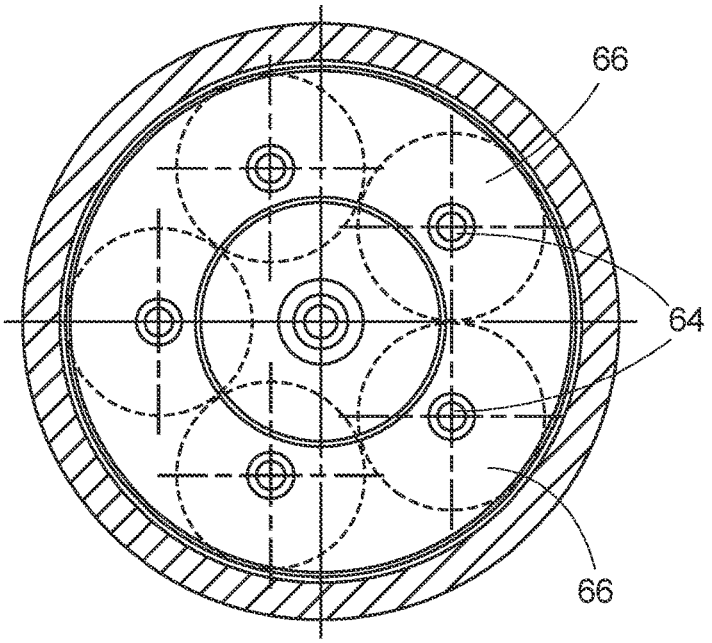
FIG. 7 is a section through line A-A on FIG. 6 prior to detonation.
Figure 6:
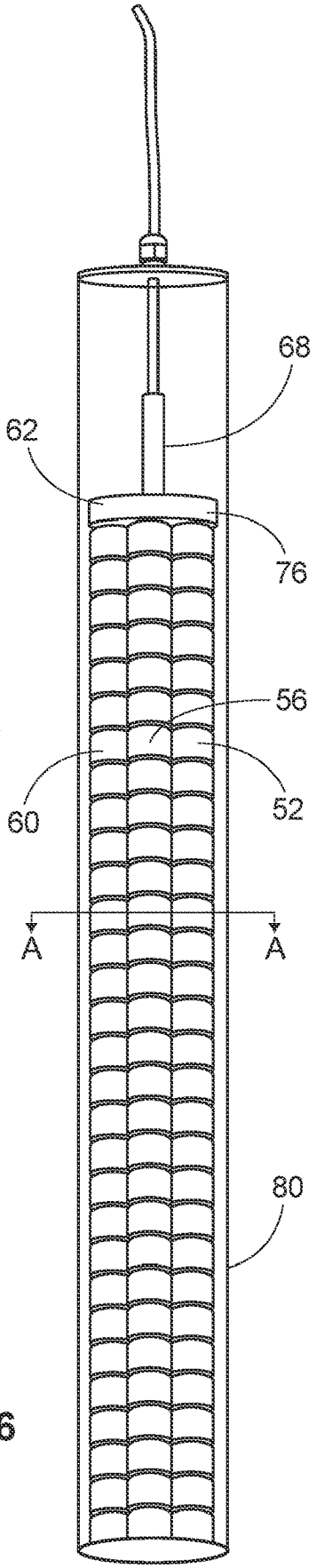
FIG. 6 is a side view of the tool of FIG. 5 with the tool housing shown partially transparent.

This arrangement can be seen more clearly in FIGS. 6 and 7; a side view of the tool 50 of FIG. 5 with the tool housing 80 shown partially transparent (FIG. 6) and a section through line A-A on FIG. 6 prior to detonation (FIG. 7).

The detonator 68 can be seen attached to the top 76 of the stacking system 62 upon which the explosive columns 52-60 are stacked. The poles 64 can be seen in FIG. 7 passing through the centre of each toroidal explosive charge 66.

Figure 8:
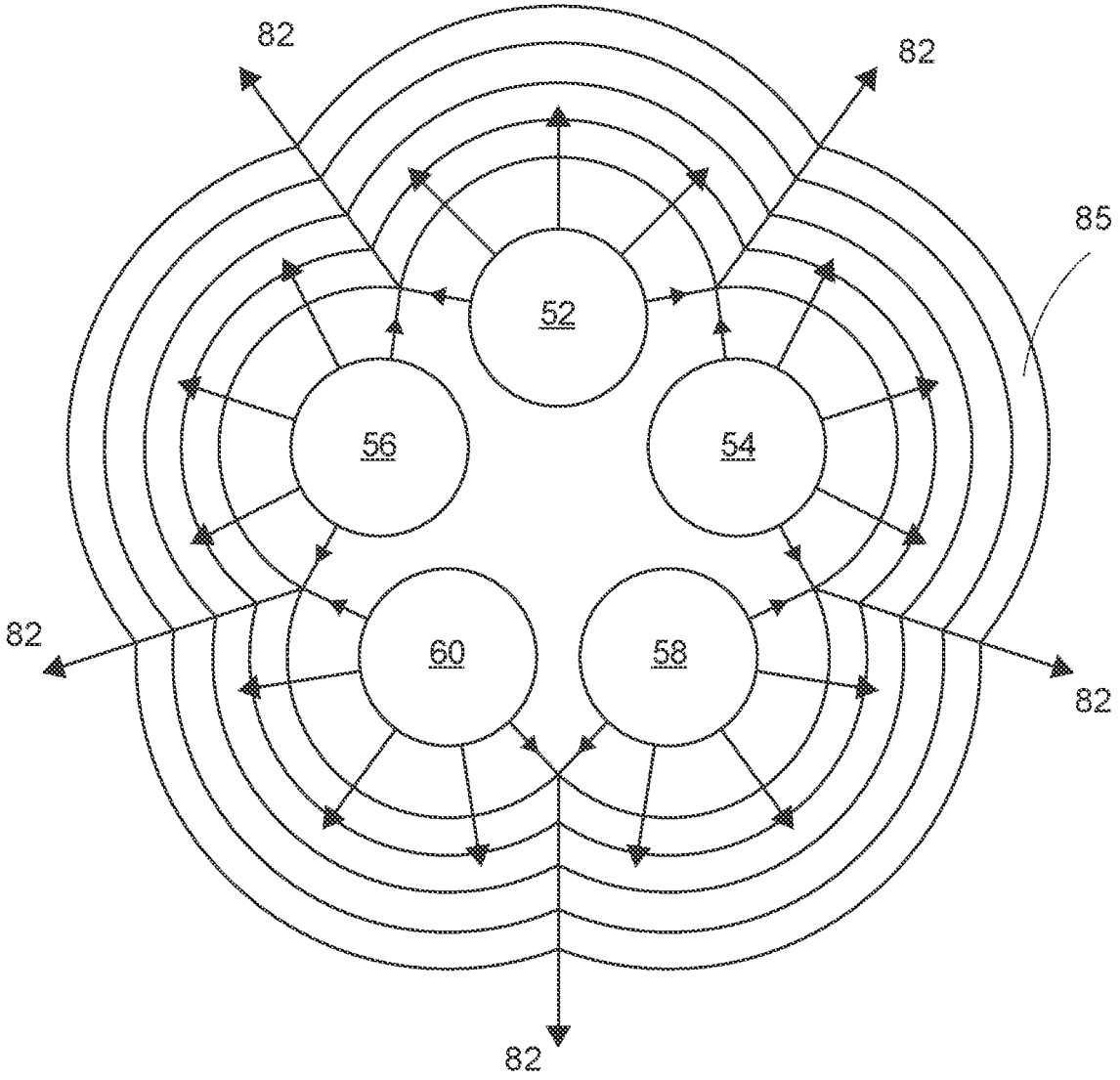
FIG. 8 is a schematic section view through the columns of explosives of the tool of FIG. 5, showing the combining of the shock waves after detonation.

Reference is now made to FIG. 8, a schematic section view through the columns of explosives 52-60 of the tool 50 of FIG. 5, showing the combining of the shock waves after ignition. This arrangement largely works in the same way as the two column arrangement of the first embodiment, however in this case the five columns of explosives 52-60 provide five combined shock waves 82. Between pairs of combined shock waves 82 are regions of non-combined shock waves 85.

Figure 9:
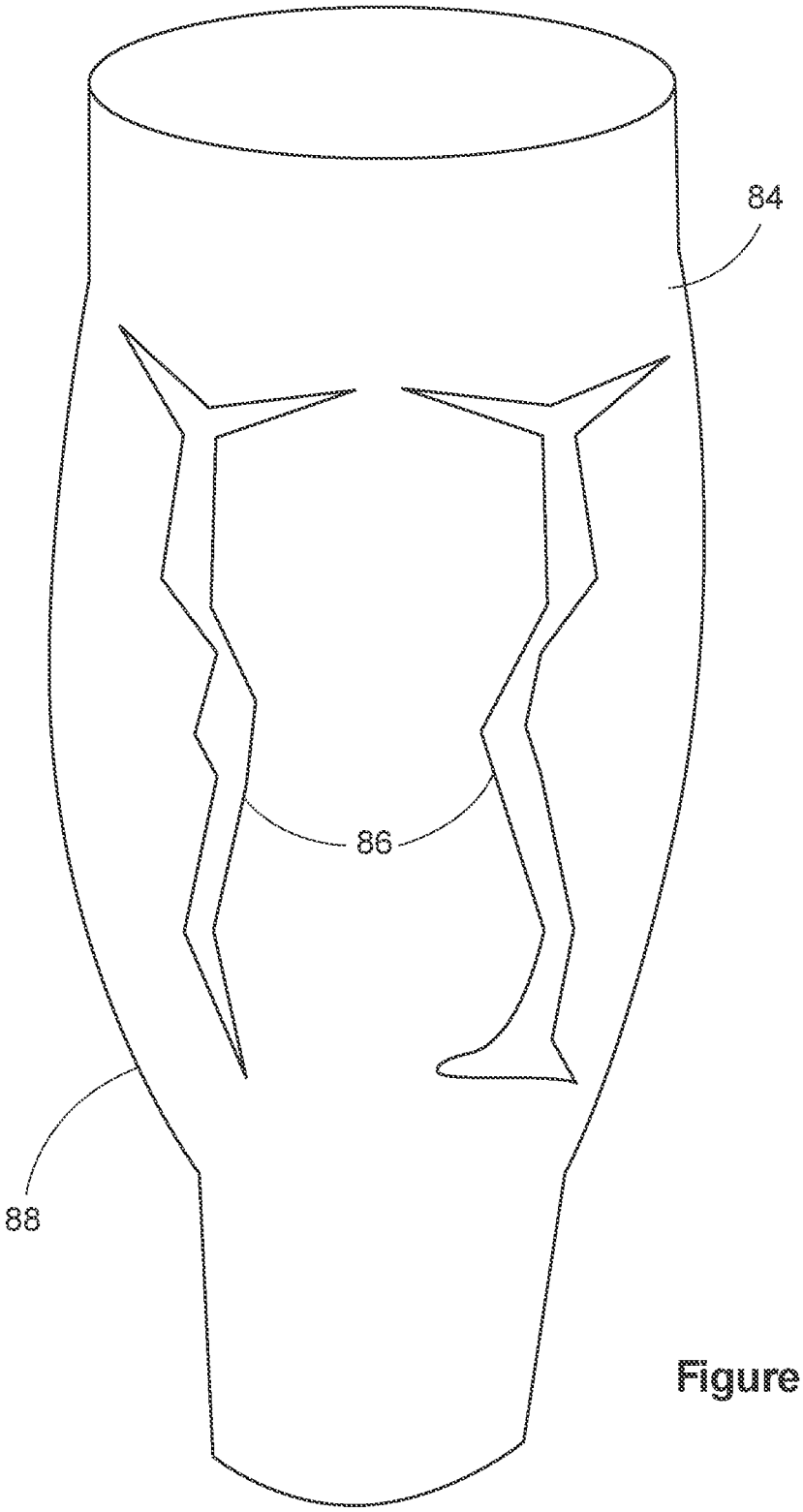
FIG. 9 is a perspective view of a tubular after firing of the tool of FIG. 5.

The effect of these five shock waves 82 on a tubular can be seen in FIG. 9, a perspective view of a tubular 84 after firing of the tool 50 of FIG. 5. This tubular 84 clearly shows fractures 86 created by shock waves and the expansion of the tubular wall 88 created by the subsequent blast wave, which has ripped the fractures 86.

Figure 10:
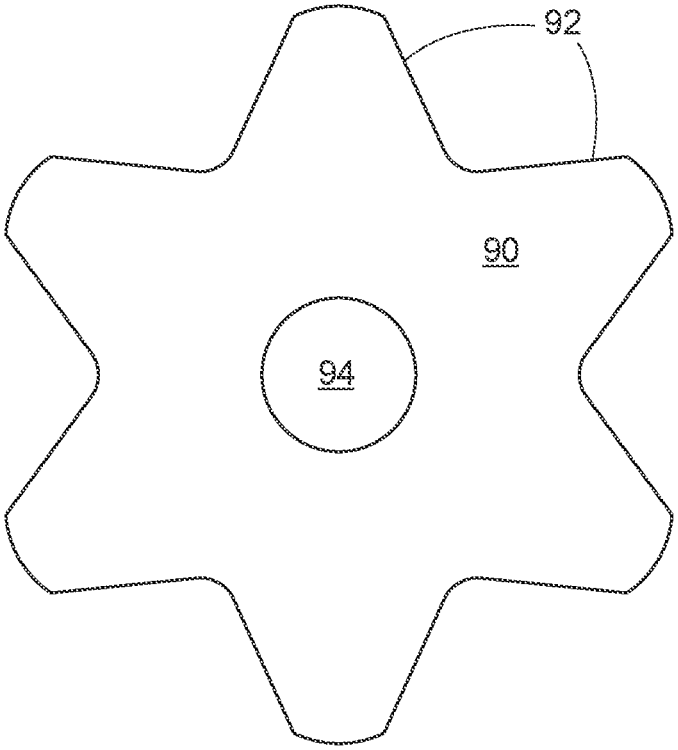
FIG. 10 is a section through an alternative column of explosive according to a third embodiment of the present invention.

Although multiple columns of explosives have been used in the two described embodiments, a single column of explosive can be used which could be shaped to enhance combining of shock waves with an interior void to maximize the energy generated during explosion. One such example of a single column explosive is shown in FIG. 10, an alternative column 90 of explosive according to a third embodiment of the present invention. The column 90 has faces 92 which are angled towards each other to assist in the combining of shock waves which will be generated and propagated away from these faces 92 upon detonation of the charge. The explosive column 90 further comprises an interior void 94 into which shock waves can be transmitted radially inwardly, to collide and reflect outwardly towards a tubular to be fractured.

Various modifications or improvements may be made to the above-described embodiments without departing from the scope of the present invention. For example, although the subterranean wells described are hydrocarbon producing wells, they could equally be geothermal or gas storage wells or the like.

Additionally or alternatively, rather than have the shock waves propagate into the interior void, a reflection arrangement could be utilized to reflect incoming shock waves away from the interior void out towards the tubular to be fractured.

The invention claimed is:

1. A tool for fracturing at least one tubular; the tool comprising:

a plurality of parallel columns of explosives, each column of explosive having a circular cross-section, and a detonation system configured to detonate the columns of explosives, wherein the columns are configured to, upon detonation, combine at least a portion of the shockwave propagating in a direction outwardly from the tool from one column of explosives with at least a portion of the shockwave propagating in a direction outwardly from the tool from another column of explosives to create a combined shockwave of greater intensity than either of the shockwaves which formed the combined shockwave.

2. The tool of claim 1, wherein multiple portions of the shockwave from one column of explosives combine with multiple portions of the shockwave from another column of explosives to create multiple combined shockwaves.

3. The tool of claim 2, wherein, where there are two columns of explosives, two combined shockwaves are formed, the shockwaves propagating away from opposite sides of the tool.

4. The tool of claim 2, wherein where there are three columns of explosives, three combined shockwaves are formed.

5. The tool of claim 1, wherein the columns of explosives are configured to propagate the portions of shockwaves outwardly to meet at an acute angle to a plane of intersection between the shockwaves, when they combine.

6. The tool of claim 1, wherein the columns of explosives are configured to provide at least two combined shockwaves, and there is a region of non-combined shockwave between the at least two combined shockwaves, the non-combined shockwave propagating from one of the plurality of parallel columns of explosives and not overlapping with a shock wave propagating from another column of the plurality of parallel columns of explosives.

7. The tool of claim 1, wherein each column of explosives comprises a plurality of explosive charges.

8. The tool of claim 7, wherein each column of explosives is a stack of explosive charges.

9. The tool of claim 8, wherein, each column of explosives has a circular cross-section, and each explosives charge is a disc.

10. The tool of claim 1, wherein the columns of explosives are arranged to define an interior void.

11. The tool of claim 10, wherein, upon detonation, at least a portion of the shockwave from each column of explosives propagates into the interior void.

12. The tool of claim 1, wherein the detonation system is configured to ignite each column of explosives simultaneously.

13. The tool of claim 1, wherein the columns of explosives are detonated in a common plane transverse to the longitudinal length of each column.

14. The tool of claim 1, wherein the explosive charges comprise one or more of the explosives PETN, RDX, HMX, PYX or HNS.

15. A method of fracturing at least one tubular, the method comprising:

providing a tool comprising a plurality of parallel columns of explosives, each column of explosive having a circular cross-section;

positioning the tool within a tubular to be fractured such that a tool longitudinal axis is parallel to a tubular longitudinal axis, detonating the plurality of parallel columns of explosives simultaneously, to combine at least one portion of a shockwave propagating outwardly from one column of explosives with at least one portion of a shockwave propagating outwardly from another column of explosives, to create a combined shockwave, the combined shockwave performing at least one longitudinal fracture in the tubular.

* * * * *